United States Patent [19]

Whitaker et al.

[11] 4,271,877

[45] Jun. 9, 1981

[54] PACKAGING MACHINE WITH FUNNEL-TYPE FILLING MECHANISM

[75] Inventors: William C. Whitaker; Allen B. Canfield, both of Sarasota, Fla.

[73] Assignee: Rexham Corporation, New York, N.Y.

[21] Appl. No.: 95,458

[22] Filed: Nov. 19, 1979

[51] Int. Cl.[3] ..... B65B 43/56

[52] U.S. Cl. ..... 141/166; 141/183; 141/258; 141/331; 222/216

[58] Field of Search ..... 141/10, 67, 68, 71–80, 141/129–191, 250–284, 331–345, 114, 312–317, 98, 392; 222/216, 221

[56] References Cited

U.S. PATENT DOCUMENTS

| | | | |
|---|---|---|---|
| 477,186 | 6/1892 | Cussen | 141/258 |
| 2,184,474 | 12/1939 | Sowden | 141/259 |
| 3,472,291 | 10/1969 | Roeschen | 222/216 |

*Primary Examiner*—Houston S. Bell, Jr.

*Attorney, Agent, or Firm*—Leydig, Voit, Osann, Mayer & Holt, Ltd.

[57] ABSTRACT

Product is delivered into a funnel which then is moved downwardly to deposit the product into a pouch. The funnel includes a movable plate which initially is disposed in a closed position to enable the funnel to receive and retain the product. As the funnel travels downwardly, the plate moves to an open position to enable the product to be delivered out of the funnel and into the pouch. When the plate moves to its open position, the interior of the funnel takes on the same shape as a plunger which moves downwardly through the funnel to force the product out of the funnel.

10 Claims, 13 Drawing Figures

PACKAGING MACHINE WITH FUNNEL-TYPE FILLING MECHANISM

BACKGROUND OF THE INVENTION

This invention relates to a packaging machine having a filling mechanism for depositing product into flexible upright pouches adapted to be advanced step-by-step along a predetermined path. Each pouch is advanced to and momentarily stops in a filling station located along the path and is filled with product during the dwell period.

The invention more particularly relates to a filling mechanism for depositing solid food product into the pouches. The food product may, for example, be discrete chunks of meat or may be stacked slices of meat such as turkey or ham.

It has been proposed to deposit such a product into the pouches through the use of a funnel-like device which moves upwardly and downwardly above the pouch in the filling station. When the funnel is in its raised position, a pre-weighed quantity of product is delivered to the funnel. The loaded funnel then is moved downwardly toward the pouch to deposit the product into the pouch. Difficulty has been encountered, however, in making certain that all of the product in the funnel is delivered to the pouch. Some types of product tend to hang up and remain in the funnel and thus the pouch receives a short fill.

SUMMARY OF THE INVENTION

The general aim of the present invention is to provide a new and improved filling mechanism in which the funnel is adapted to change shapes in a unique manner to receive, retain and release the product and in which all of the product is positively forced out of the funnel and into the pouch to insure a complete fill.

A more detailed object of the invention is to provide a novel funnel which, in its raised position, defines a funnel-like receptacle for receiving and retaining the product and which, when lowered, assumes a configuration permitting complete and positive discharge of the product out of the funnel.

Still another object is to positively force the product out of the funnel with a vertically movable plunger, the funnel being capable of assuming substantially the same cross-sectional shape as the plunger so as to enable the plunger to clean all of the product out of the funnel.

The invention also resides in the unique coaction between the funnel and novel pouch openers which form the pouch into a shape permitting entry of the funnel into the pouch.

These and other objects and advantages of the invention will become more apparent from the following detailed description when taken in conjunction with the accompanying drawings.

DETAILED DESCRIPTION OF THE PREFERRED EMBODIMENT

Figures 1, 2:
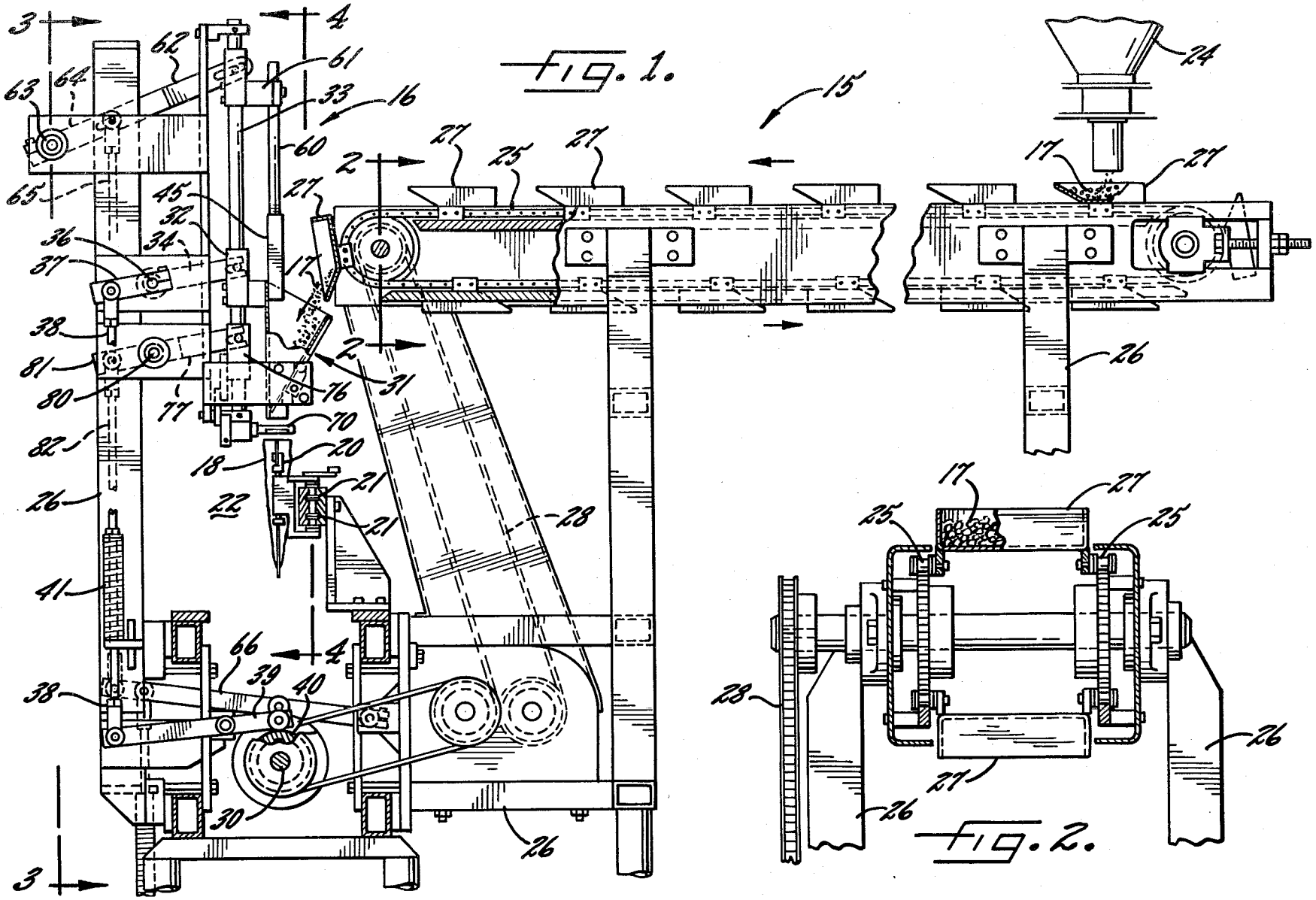
FIG. 1 is a side elevational view of a packaging machine equipped with a new and improved filling mechanism incorporating the unique features of the present invention.
FIG. 2 is an enlarged fragmentary cross-section taken substantially along the line 2—2 of FIG. 1.

As shown in the drawings for purposes of illustration, the invention is embodied in a packaging machine 15 which is equipped with a filling mechanism 16 for depositing product 17 into envelope-type pouches 18 made from flexible, heat-sealable material. In the present instance, the product consists of solid and discrete meat chunks (e.g., beef cubes) which are delivered into the pouches after the latter have been partially filled with sauce, gravy or the like.

Each pouch 18 is held in an upright position by a pair of clamps 20 (FIG. 3) attached to a pair of intermittently movable chains 21 adapted to advance a row of spaced pouches edgewise along a predetermined path. Every time the chains stop, one pouch momentarily dwells in a filling station 22 located adjacent the filling mechanism 16. During the dwell period, a pre-weighed quantity of meat chunks 17 is deposited into the pouch in the filling station. When the pouch first dwells, its upper end or mouth is held in a partially open position by virtue of the two bag clamps 20 being shifted toward one another to partially spread the side panels of the pouch (see FIG. 7*a*).

In the present instance, a bulk supply of meat chunks 17 is contained in a large hopper 24 (FIG. 1) which is spaced laterally or rearwardly from the filling station 22. The hopper is spaced above the upstream end of an overhead endless conveyor 25 which is supported on the main frame 26 of the machine 15 and which carries a plurality of spaced buckets 27. The conveyor is adapted to be advanced intermittently and from right-to-left (FIG. 1) by a chain drive 28 which is operably connected to the main drive shaft or cycle shaft 30 of the machine. Each time the conveyor stops, one bucket 27 dwells beneath the hopper 24 and is filled with a precisely weighed quantity of meat chunks 17. Each filled bucket then is advanced from right-to-left by the conveyor and ultimately curves around the downstream end of the conveyor and dwells in an upright position. As the bucket first approaches and then dwells in its upright position, the meat chunks are dumped out of the bucket and fall downwardly under the influence of gravity.

Figure 4:
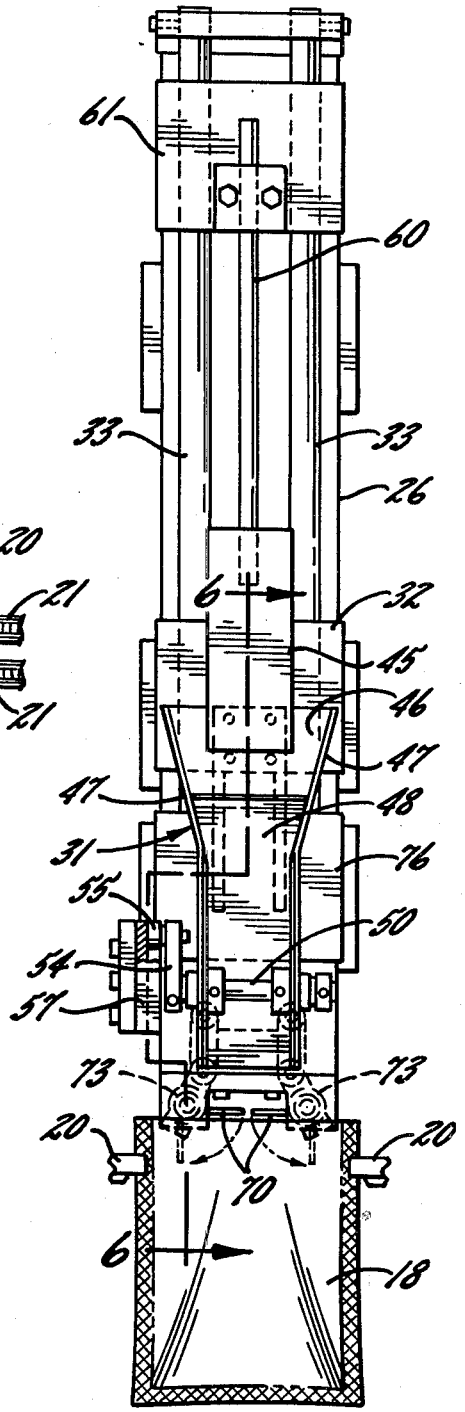
FIG. 4 is an enlarged fragmentary cross-section taken substantially along the line 4—4 of FIG. 1.
Figure 11:
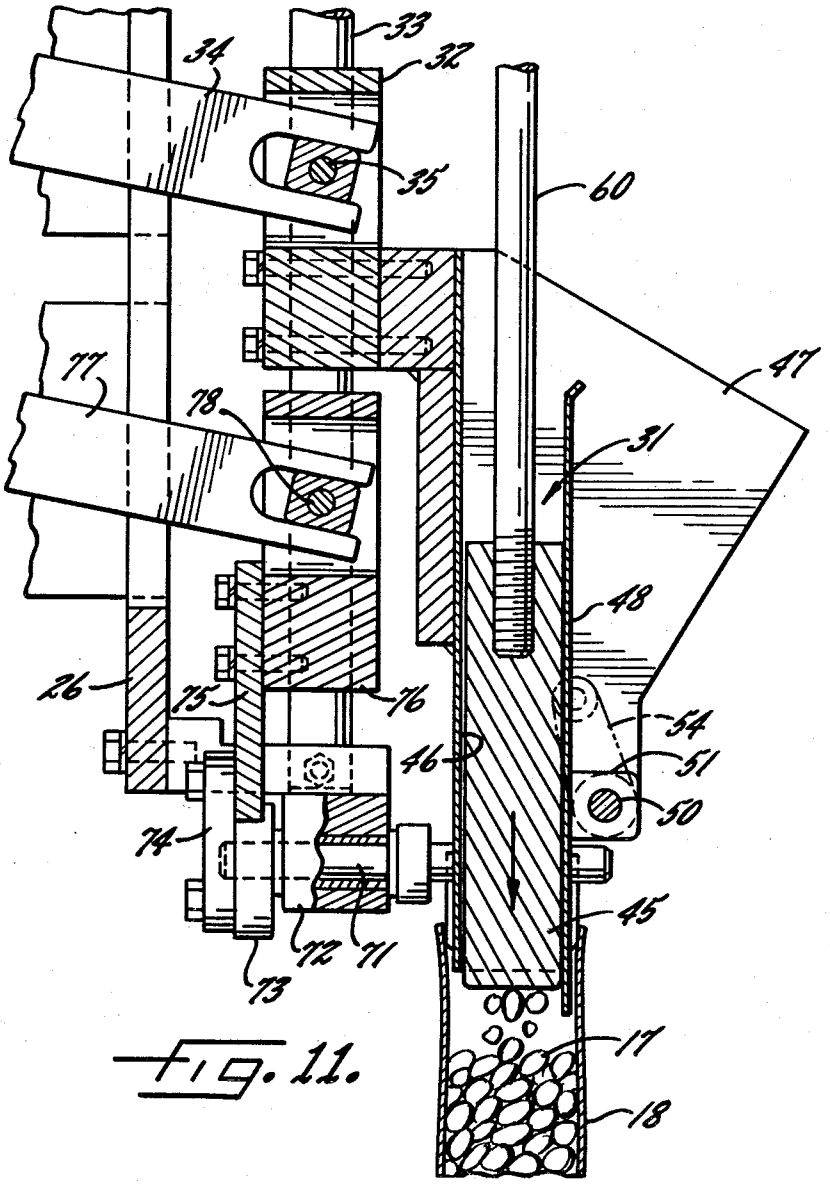
FIGS. 10 and 11 also are views similar to FIG. 6 but show parts of the filling mechanism in successively moved positions.
Figure 10:
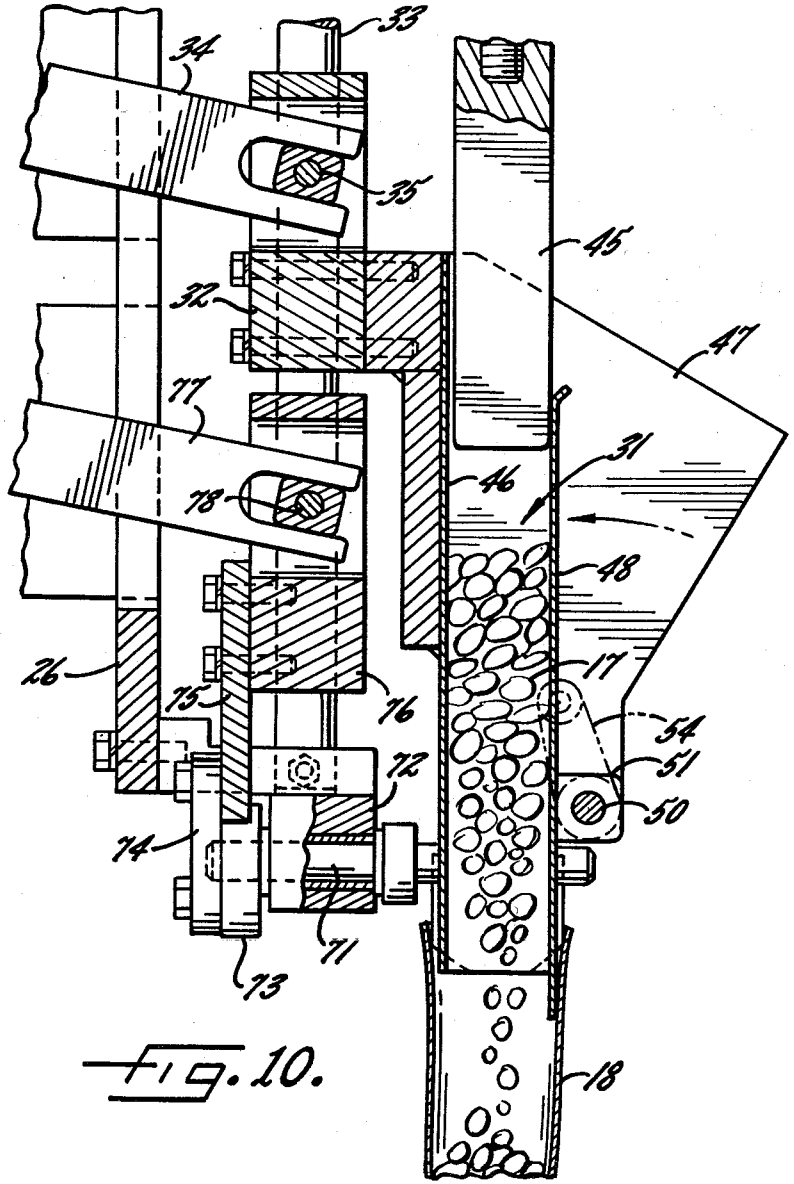

The meat chunks 17 dumped from each bucket 25 are delivered to and caught by a funnel 31 which is adapted to be moved downwardly and upwardly between a raised receiving position (FIGS. 1, 4 and 6) and a lowered depositing position (FIGS. 10 and 11). The funnel is located directly above the filling station 22 and is moved vertically between its two positions. When the funnel is in its upper receiving position, it is located in close underlying relationship with the upright bucket 27 on the conveyor 25 (see FIG. 1) and is spaced above the upper ends of the pouches 18. As the funnel reaches its lowered position, it ducks downwardly into the pouch in the filling station and deposits the meat chunks 17 into such pouch (see FIGS. 10 and 11).

Upward and downward movement of the funnel 31 is effected in timed relation with the advance of the pouches 18 and the buckets 27. Specifically, the funnel is retracted upwardly from a newly filled pouch 18 in the filling station 22 and that pouch then is advanced out of the filling station while the following pouch is advanced into the filling station. The funnel reaches its upper position in time to catch the meat chunks 17 being dumped from the upright bucket 27 and then moves downwardly to duck into the next pouch, the latter having stopped in the filling station prior to the arrival of the funnel.

The funnel 31 is supported for vertical movement by a slide 32 (FIGS. 4 and 6) which is guided for up and down sliding on a pair of upright rods 33 fixed to the frame 26 of the machine 15 adjacent the forward side thereof. A crank 34 (FIGS. 1 and 6) is pivotally connected to the slide 32 at 35 and is fixed to a shaft 36 which is rotatably supported by the frame 26. A second crank 37 is fixed to one end of the shaft and is connected pivotally to the upper end of an upright link 38 (FIG. 3) whose lower end is pivotally connected to a lever 39 which is pivotally mounted on the frame 26. The lever is adapted to be rocked upwardly and downwardly by a rotatable cam 40 on the cycle shaft 30 and is biased against the cam by a spring 41 on the link 38. As the cycle shaft rotates, the cam 40 and the spring 41 act through and against the lever 40, the link 38 and the cranks 37 and 34 to move the slide 32 and the funnel 31 upwardly and downwardly along the guide rods 33. This type of actuating mechanism is widely used in packaging machines and reference may be made to Johnson et al U.S. Pat. No. 3,410,052 for a more detailed disclosure of the construction and operation of such a mechanism.

In accordance with the primary aspect of the invention, the funnel 31 is uniquely constructed so that, when the funnel is in its upper position, the funnel is shaped to define a wide mouth for receiving the chunks 17 being dumped from the adjacent bucket 27 and is shaped so as to retain such chunks. When the funnel moves downwardly, however, it assumes a shape permitting the funnel to duck into the pouch 18 and permitting rapid discharge of the chunks from the funnel. Moreover, a plunger 45 uniquely coacts with the funnel and moves downwardly into the funnel to force the chunks out of the funnel with a positive action thereby to insure that all of the chunks will be delivered into the pouch.

More specifically, the funnel 31 is formed by a fixed section and by a movable section which is adapted to swing between closed and open positions relative to the fixed section. The fixed section of the funnel is defined by a vertically extending front plate 46 (FIG. 6) secured at its upper end to the slide 32 and disposed substantially in vertical alinement with the front panel of the pouch 18 in the filling station 22. Two generally triangular and horizontally spaced side plates 47 are joined rigidly to the side edges of the front plate 46 and project rearwardly therefrom. The lower end portions of the side plates are generally rectangular as indicated at 47*a* in FIG. 6.

Figure 5:
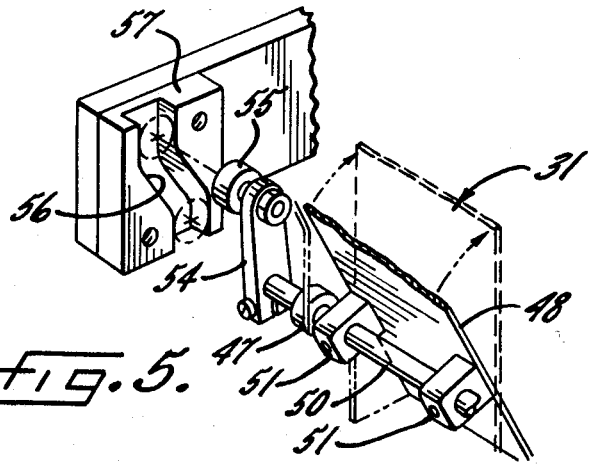
FIG. 5 is an enlarged exploded perspective view of certain parts shown in FIG. 4.
Figures 6, 7, 7A, 8, 8A, 9:
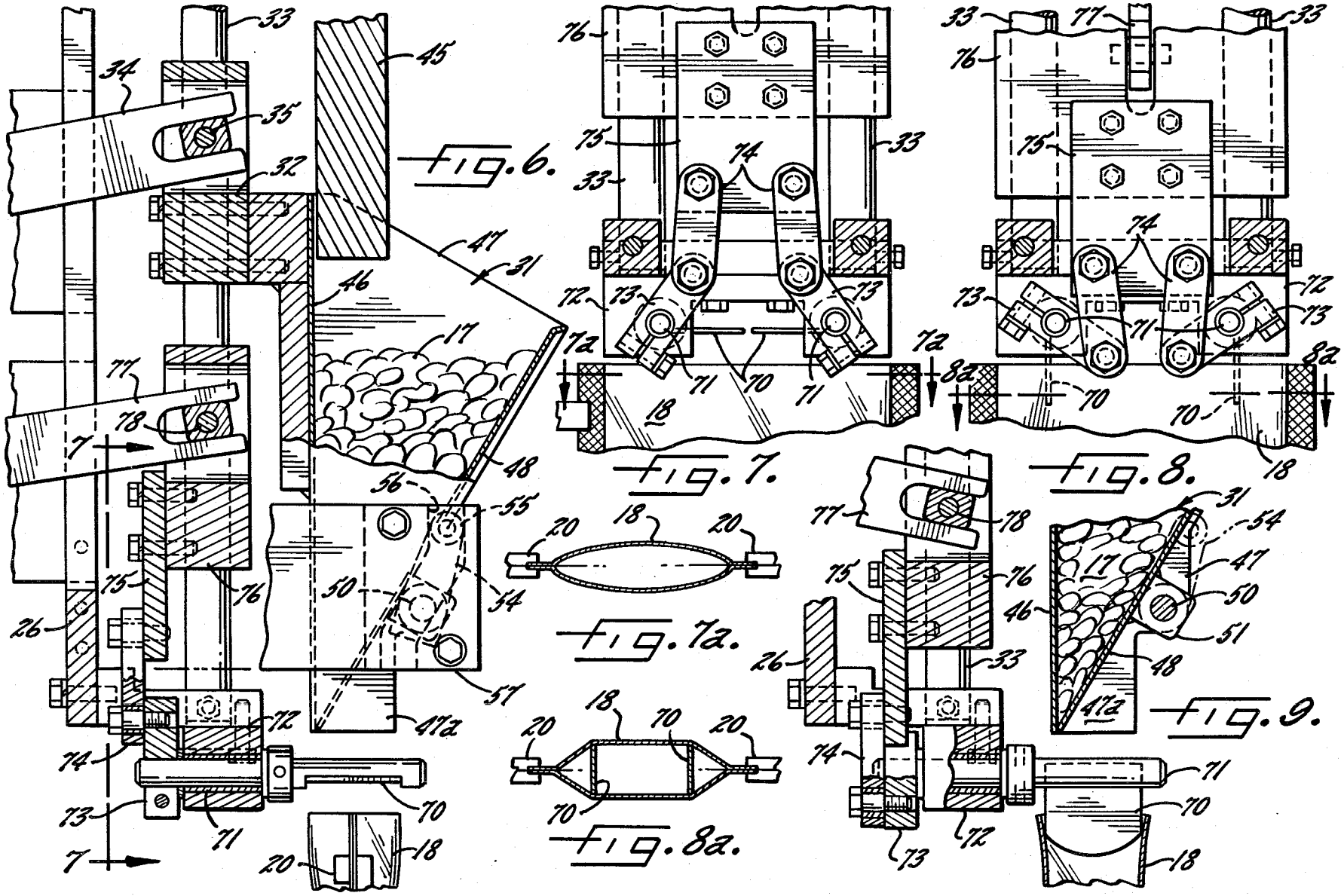
FIG. 6 is an enlarged fragmentary cross-section taken substantially along the line 6—6 of FIG. 4.
FIG. 7 is a fragmentary cross-section taken substantially along the line 7—7 of FIG. 6.
FIG. 7*a* is a cross-section, on a reduced scale, taken substantially along the line 7*a*—7*a* of FIG. 7.
FIG. 8 is a view similar to FIG. 7 but shows certain parts in moved positions.
FIG. 8*a* is a cross-section, on a reduced scale, taken substantially along the line 8*a*—8*a* of FIG. 8.
FIG. 9 is a fragmentary view similar to FIG. 6 but shows certain parts in moved positions.

The movable section of the funnel 31 is formed by a plate 48 which is located between and closely adjacent the two side plates 47 and which is adapted to swing relative to the front plate 46 between a closed position shown in FIG. 6 and an open position shown in FIG. 10. For this purpose, a horizontal shaft 50 (FIG. 5) is located above the lower edge of the movable plate 48 and extends through the side plates 47 and through ears 51 projecting rearwardly from the movable plate. The shaft 50 is supported rotatably by the side plates 47 and is fastened securely to the ears 51. Thus, the plate 48 swings about the axis of the shaft 50 when the latter is turned.

When the funnel 31 is in its upper position (FIG. 6), the movable plate 48 is located in its closed position relative to the front plate 46 and is inclined downwardly and forwardly. When the movable plate is so located, its lower edge contacts the front plate and thus the lower end of the funnel 31 is completely closed off by those two plates and by the side plates 47. In addition, the plate 48 diverges away from the plate 46 as the plate 48 progresses upwardly and hence a relatively wide mouth is defined at the upper end of the funnel. Accordingly, the funnel is capable of catching and holding all of the chunks 17 dumped from the adjacent bucket 27.

As the funnel 31 moves downwardly, the plate 48 is swung counterclockwise about the axis of the shaft 50 and swings to its open position (FIGS. 10 and 11) to permit the chunks 17 to discharge from the funnel. To effect such swinging, a crank 54 (FIG. 5) is attached to one end of the shaft 50 and carries a cam follower 55 in the form of a rotatable roller. The follower rides in a cam track 56 which is formed in a stationary block 57 attached to and projecting rearwardly from the frame 26 adjacent one side of the funnel. Shortly after the funnel begins its downward travel, the cam track 56 acts through the follower 55 and the crank 54 and causes the shaft 50 to turn counterclockwise so as to swing the plate 48 from its closed position shown in FIG. 6 to its open position shown in FIG. 10. The plate remains in its open position as the funnel 31 ducks into the pouch 18, as the chunks 17 are deposited into the pouch and as the funnel initially retracts from the pouch. After the funnel has cleared the upper end of the pouch, the cam track 56 effects reverse swinging of the plate 48 so as to close the plate preparatory to the funnel receiving chunks 17 from the next bucket 27.

In carrying out the invention, the movable plate 48 of the funnel 31, upon reaching its open position, extends parallel to the front plate 46 and coacts with that plate and with the side plates 47 to cause the interior of the funnel to be rectangular and block-like in shape (see FIG. 10). The plunger 45 is also rectangular and block-like and corresponds closely in cross-sectional size and shape to the cross-sectional size and shape of the open funnel. After the movable plate 48 of the funnel has been swung to the open position shown in FIG. 10, the plunger 45 is moved downwardly into the funnel 31 and forces the meat chunks 17 out of the funnel and into the pouch 18 (see FIG. 11). Because the plunger and the interior of the funnel are of substantially the same shape, the plunger completely cleans out the funnel.

As shown in FIG. 11, the plunger 45 is defined by a rectangular block which is carried on the lower end of a vertical rod 60. The plunger is adapted to be moved from a raised position (FIGS. 1 and 4) to a lowered position (FIG. 11) and is located in its raised position when the funnel 31 is in its upper, receiving position and when the movable plate 48 of the funnel is in its closed position. When the plunger 45, the funnel 31 and the plate 48 are so located, the lower end of the plunger is located adjacent the upper end of the front plate 46 and is spaced forwardly from the plate 48 so as to not interfere with the dumping of meat chunks 17 into the relative wide open mouth of the funnel. The plunger 45 starts moving downwardly with the funnel 31 after the latter has been filled with meat chunks and then continues to move downwardly after the funnel has reached its lowered position and the movable plate 48 has been swung to its open position. During such continued movement, the plunger travels downwardly through the box-like funnel to force the meat chunks therefrom, the lower end of the plunger being located just below the lower end of the front plate 46 when the plunger reaches its extreme lower position (see FIG. 11). After the meat chunks have been forced from the funnel, the plunger is retracted upwardly just prior to retraction of the funnel.

The rod 60 which supports the plunger 45 is spaced rearwardly from the guide rods 33 and is secured to a slide 61 (FIGS. 1 and 4) located above the slide 32 and adapted to move upwardly and downwardly on the guide rods. A crank 62 (FIG. 1) is pivotally connected to the slide 61 and is rigidly connected to a shaft 63 which is rotatably supported by the frame 26. A second crank 64 (FIG. 3) is secured to the shaft and is pivotally connected to the upper end of a vertical link 65. The lower end of the link 65 is connected to a lower lever 66 (FIG. 1) which is adapted to be rocked upwardly and downwardly by a cam 67 (FIG. 3) on the cycle shaft 30, the lever 66 being biased into engagement with the cam by a spring 68 on the link 65. The cam 67 acts through the lever 66, the link 65 and the cranks 64 and 62 to move the slide 61 and the plunger 45 upwardly and downwardly.

As a secondary aspect of the invention, unique pouch openers 70 (FIGS. 7 and 9) are located in the filling station 22 and serve to form the upper end portion of the pouch 18 in the filling station into a rectangular shape corresponding generally to the rectangular shape of the funnel 31 so that the pouch may accept entry of the funnel. Herein, there are two pouch openers 70 and each is in the form of a substantially flat blade. As each pouch is advanced into the filling station 22, the two pouch opening blades 70 are located in inactive positions (FIGS. 6 and 7) above the pouch and extend horizontally toward one another. When the pouch dwells, the blades 70 swing downwardly and enter the mouth of the pouch, such entry being permitted as a result of the mouth of the pouch being held in a partially open position by the clamps 20 (see FIG. 7*a*). The blades are swung downwardly until they reach substantially vertical positions (FIGS. 8 and 9) and, during such swinging, the blades open the pouch and square up the sides of the pouch as shown in FIG. 8*a* for purposes of receiving the funnel 31.

Figure 3:
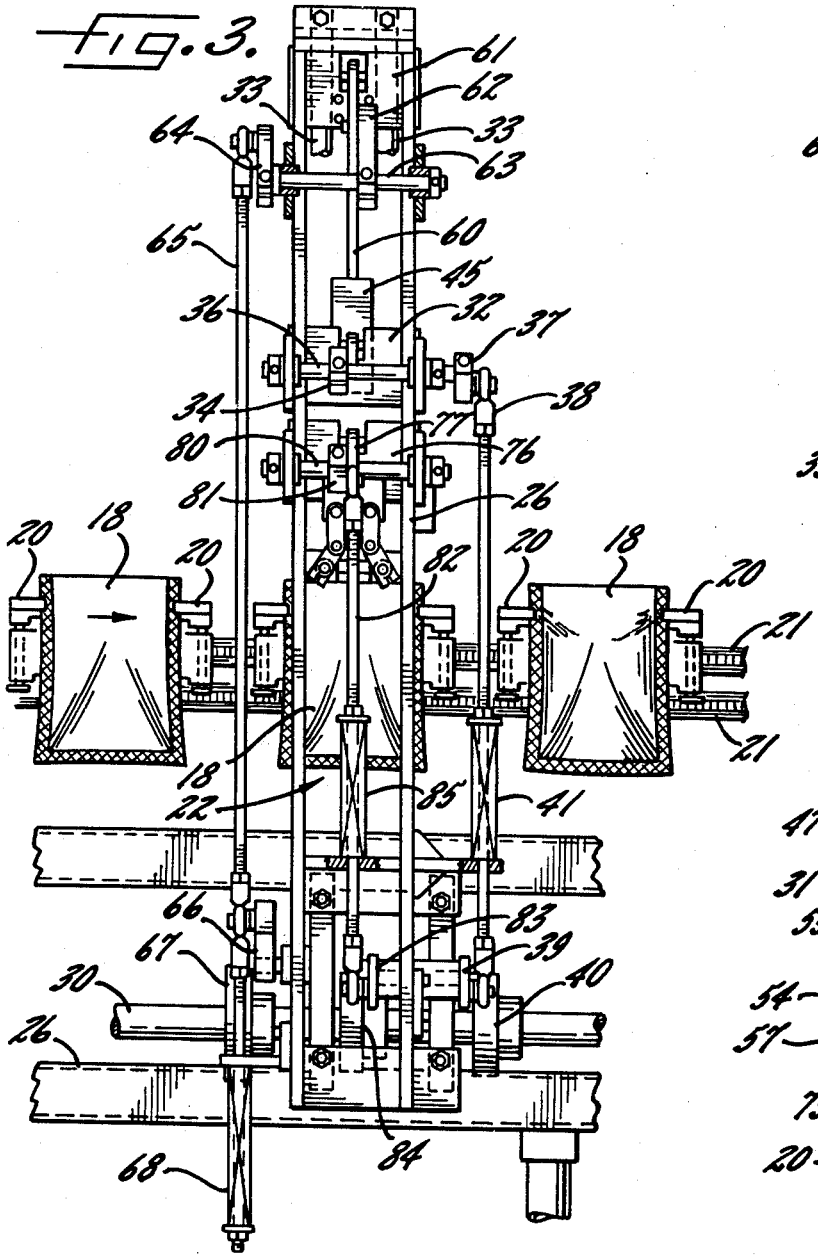
FIG. 3 is a fragmentary cross-section taken substantially along the line 3—3 of FIG. 1.

Each pouch opening blade 70 is mounted on and extends radially from the rear end portion of a horizontally extending shaft 71 which is journaled for rotation in a block 72 secured to the frame 26. A crank 73 is fastened securely to the forward end portion of each shaft 71 and is pivotally connected to the lower end of a link 74. The upper end of each link is pivotally connected to a plate 75 which, in turn, is secured rigidly to a slide 76 located beneath the slide 32 and adapted to move upwardly and downwardly on the guide rods 33. A crank 77 (FIG. 6) is pivotally connected at 78 to the slide 76 and is secured rigidly to a shaft 80 (FIG. 1) which is rotatably supported by the frame 26. A second crank 81 is rigidly connected to the shaft and is pivotally connected to the upper end of a link 82 whose lower end is pivotally connected to a lever 83 (FIG. 3). The lever 83 engages a cam 84 on the cycle shaft 30 and is biased against the cam by a spring 85. Turning of the cam 84 causes the lever 83, the link 82 and the cranks 81 and 77 to move the slide 76 downwardly and upwardly on the guide rods 33. When the slide moves downwardly, the links 74 (FIGS. 7 and 8) act through the cranks 73 to turn the shafts 71 and swing the opening blades 70 downwardly to their vertical positions (FIGS. 8 and 9) and square up the pouch 18. Upward retraction of the slide 76 swings the blades reversely to withdraw the blades from the pouch and to move the blades to their inactive, horizontal positions (FIG. 7). The blades are swung downwardly just after the pouch initially dwells and before the funnel 31 moves downwardly into the pouch. Upward swinging of the blades occurs just after the funnel has been retracted out of the filled pouch and just before the pouch is advanced out of the filling station 22.

SUMMARY OF OPERATION

At the beginning of a cycle, the funnel 31 is located in its upper, receiving position, the front plate 48 is in its closed position, the plunger 45 is in its upper, retracted position and the opening blades 70 are in their inactive positions (see FIG. 6). As soon as a pouch 18 stops in the filling station 22, the opening blades are swung downwardly to their active positions (FIGS. 8 and 9) to square up the pouch and enable the pouch to accept entry of the funnel. During this time, meat chunks 17 are being dumped into the funnel from the adjacent bucket 27. Thereafter, the funnel and the plunger 45 are moved downwardly.

As the funnel 31 shifts downwardly, the movable plate 48 is swung to its open position and, just shortly after the plate reaches that position, the funnel ducks into the pouch 18 and stops (see FIG. 10). The plunger 45, however, continues its downward movement and moves through the funnel to force all of the chunks 17 out of the funnel as shown in FIG. 11.

The plunger 45 is retracted upwardly immediately after it reaches its lowermost position. After the plunger begins its upward movement, the funnel 31 is retracted upwardly and, after the funnel clears the pouch 18, the plate 48 is swung to its closed position. Once the funnel has cleared the pouch, the opening blades 70 are retracted from the pouch and are swung to their inactive positions. This enables the filled pouch to be indexed out of the filling station 22 and enables the next pouch to be indexed into the filling station to begin the next cycle.

From the foregoing, it will be apparent that the present invention brings to the art a new and improved filling mechanism 16 having a unique funnel 31 which assumes one shape to receive and retain the product 17 and which takes on a different shape to enter the pouch 18 and dispense the product. The latter shape corresponds to the shape of the plunger 45 and thus the plunger is effective to force all of the product out of the funnel. By virtue of the plunger, there is no danger of the product jamming in or sticking to the funnel as otherwise might be the case in the absence of the plunger or if the plunger and the funnel were of different shapes.

We claim:

1. A packaging machine for depositing product into upright pouches adapted to be advanced step-by-step along a predetermined path and each adapted to dwell in a filling station, said machine comprising an upright funnel mounted to move downwardly and upwardly between receiving and depositing positions, said funnel being located above said filling station when said funnel is in said receiving position and being located at least partially within a pouch dwelling in said filling station when the funnel is in said depositing position, said funnel having first and second sections, means mounting said second section to swing relative to said first section and about a horizontal axis between a closed position in which the second section retains product in the funnel and an open position in which the second section allows product to be dispensed from the lower end of the funnel, said second section being disposed in said closed position when said funnel is in said receiving position, means for delivering product into the upper end of said funnel when said funnel is in said receiving position, means for thereafter moving said funnel downwardly toward said depositing position, means for thereafter moving said second section of said funnel to said open position, and a plunger for forcing product out of said funnel and into said pouch after said second section of said funnel has moved to said open position, the cross-sectional size and shape of said plunger corresponding substantially to the cross-sectional size and shape of the interior of said funnel when said second section of said funnel is in said open position.

2. A packaging machine as defined in claim 1 in which said plunger is alined vertically with said funnel and is mounted to move downwardly and upwardly between raised and lowered positions, said plunger being located in said raised position and being located adjacent the upper end of said funnel when said funnel is in said receiving position, said plunger moving into said funnel when said plunger is moved to said lowered position, and means for moving said plunger toward said lowered position as said funnel moves toward said depositing position and for moving said plunger into said lowered position after said funnel has reached said depositing position.

3. A packaging machine as defined in claim 2 in which said first and second sections of said funnel comprise first and second plates, respectively, said first plate being disposed in a substantially vertical plane, said second plate diverging upwardly away from said first plate when said second plate is in said closed position and extending substantially parallel to said first plate when said second plate is in said open position, said plunger being of substantially rectangular cross-section.

4. A packaging machine as defined in claim 3 in which said mounting means support said second plate to swing between said closed and open positions about a generally horizontal axis located above the lower end of said second plate.

5. A packaging machine as defined in claim 3 further including means located adjacent said filling station and movable downwardly into the pouch in the filling station to form the upper end of the pouch into a substantially rectangular shape before said funnel reaches said depositing position.

6. A packaging machine for depositing product into upright pouches adapted to be advanced step-by-step along a predetermined path and each adapted to dwell in a filling station, said machine comprising an upright funnel mounted to move downwardly and upwardly between receiving and depositing positions, said funnel being located above said filling station when said funnel is in said receiving position and being located at least partially within a pouch dwelling in said filling station when the funnel is in said depositing position, said funnel comprising first and second plates, said first plate being disposed in a substantially vertical plane, said second plate being mounted to swing between closed and open positions relative to said first plate about a substantially horizontal axis located above the lower end of said second plate and being located in said closed position when said funnel is in said receiving position, said second plate diverging upwardly away from said first plate and retaining product in said funnel when said second plate is in said closed position, said second plate extending substantially parallel to said first plate and allowing product to be dispensed from the lower end of said funnel when said second plate is in said open position, a plunger alined vertically with said funnel and mounted to move downwardly and upwardly between raised and lowered positions, said plunger being located in said raised position and being located adjacent the upper end of said funnel when said funnel is in said receiving position, said plunger moving downwardly into said funnel when said plunger is moved to said lowered position, means for delivering product into the upper end of said funnel when said funnel is in said receiving position, means for thereafter moving said funnel downwardly to said depositing position, means for moving said second plate of said funnel to said open position as said funnel moves downwardly, and means for moving said plunger to said lowered position to shove said product out of said funnel and into the pouch in said filling station.

7. A packaging machine as defined in claim 6 in which the interior of said funnel is of substantially rectangular cross-sectional shape when said second plate is in said open position, said plunger having a lower end portion which substantially corresponds in shape to said cross-sectional shape.

8. A packaging machine as defined in claim 7 further including openers adapted to enter the pouch in said filling station and form the upper end portion of such pouch into a shape which corresponds substantially to the shape of the lower end portion of said funnel when said second plate is in said closed position.

9. A packaging machine as defined in claim 7 in which said funnel further includes a pair of spaced side plates connected to said first plate and projecting at right angles from said first plate, said second plate being located between said side plates.

10. A packaging machine as defined in claim 9 in which the lower end portion of said second plate engages the lower end portion of said first plate when said second plate is in said closed position.

* * * * *